US008261379B2

(12) United States Patent
Miller

(10) Patent No.: US 8,261,379 B2
(45) Date of Patent: Sep. 11, 2012

(54) MODIFIED DECK PLATE FOR USE WITH CORRUGATED SUPPORT SURFACE

(75) Inventor: Vince Miller, Las Vegas, NV (US)

(73) Assignee: Zurn Industries, LLC, Erie, PA (US)

( * ) Notice: Subject to any disclaimer, the term of this patent is extended or adjusted under 35 U.S.C. 154(b) by 1504 days.

(21) Appl. No.: 11/732,114

(22) Filed: Apr. 2, 2007

(65) Prior Publication Data

US 2008/0028515 A1 Feb. 7, 2008

Related U.S. Application Data

(60) Provisional application No. 60/788,905, filed on Apr. 4, 2006.

(51) Int. Cl.
*E03C 1/12* (2006.01)
*E03F 5/04* (2006.01)

(52) U.S. Cl. ..... 4/679; 4/695; 52/302.1; 52/219

(58) Field of Classification Search ..... 52/302.1, 52/219, 220.8, 712, 715; 285/42; 210/163, 210/164; 137/362; 4/288, 679; 248/74.1, 248/74.62, 315, 317, 342–345
See application file for complete search history.

(56) References Cited

U.S. PATENT DOCUMENTS 598,992 A 2/1898 Hosford
645,749 A * 3/1900 Kasschau ..... 4/287
895,913 A * 8/1908 Tracy ..... 4/288
917,847 A * 4/1909 Corey ..... 174/180
925,324 A * 6/1909 Gavin et al. ..... 4/643
928,596 A * 7/1909 Friedman ..... 4/288
1,059,671 A * 4/1913 Holt ..... 285/42
1,123,705 A 1/1915 Dehn
1,532,897 A 4/1925 Hirshstein
1,557,515 A * 10/1925 Wooley ..... 248/343
1,676,276 A * 7/1928 Moore ..... 285/10
1,690,630 A 11/1928 Fleming
1,703,649 A * 2/1929 Weinstein ..... 248/343
1,746,775 A 2/1930 Johnson et al.
1,963,300 A 6/1934 Fleming
1,991,772 A * 2/1935 Rieger et al. ..... 210/166
2,003,770 A * 6/1935 Goodhart ..... 210/163
2,019,779 A * 11/1935 Fleming ..... 285/18
2,127,167 A * 8/1938 Fraters ..... 285/13

(Continued)

OTHER PUBLICATIONS

Roof Accessories Company, Inc., "Standard Model Retrofit Drain (SM)"; Website: www.racdrains.com, dated Aug. 28, 2001, (pp. 1-3).

(Continued)

*Primary Examiner* — Robert Canfield
(74) *Attorney, Agent, or Firm* — The Webb Law Firm

(57) ABSTRACT

A floor drain support plate for mounting and securing a floor drain to a floor structure includes body having a peripheral edge, an interior cavity and a center passageway spaced radially apart from the peripheral edge and adapted to receive a pipe. The body of the support plate defining at least one slot adapted to be aligned with the floor drain for receiving a member for attaching the floor drain to the body of the support plate. A flange is attached to the body of the support plate and extends away from the interior cavity, the flange defining at least one flange slot adapted to receive a fastener, and two opposed elongated members or wing sections extending from said flange.

8 Claims, 7 Drawing Sheets

U.S. PATENT DOCUMENTS

| | | | | | |
|---|---|---|---|---|---|
| 2,243,923 | A | * | 6/1941 | Swanstrom | 411/113 |
| 2,672,205 | A | * | 3/1954 | McDonald | 285/42 |
| 2,700,526 | A | * | 1/1955 | Jackson | 248/343 |
| 2,936,502 | A | * | 5/1960 | Newcomer, Jr. | 411/549 |
| 3,052,065 | A | * | 9/1962 | Rettman | 52/27 |
| 3,060,538 | A | * | 10/1962 | Simi | 411/549 |
| 3,287,742 | A | | 11/1966 | Gaddis | |
| 3,438,066 | A | * | 4/1969 | Morris | 4/288 |
| 3,695,324 | A | * | 10/1972 | Gulistan | 411/111 |
| 4,212,486 | A | | 7/1980 | Logsdon | |
| 4,261,598 | A | * | 4/1981 | Cornwall | 285/56 |
| 4,487,690 | A | | 12/1984 | Logsdon | |
| 4,505,814 | A | | 3/1985 | Marshall | |
| 4,557,650 | A | * | 12/1985 | Molina | 411/108 |
| 5,121,905 | A | * | 6/1992 | Mann et al. | 267/141.4 |
| 5,154,024 | A | | 10/1992 | Noel | |
| 5,618,416 | A | | 4/1997 | Haefner | |
| 5,624,202 | A | * | 4/1997 | Grierson | 403/327 |
| 5,966,884 | A | | 10/1999 | Uglow | |
| 6,076,559 | A | | 6/2000 | Castillo et al. | |
| 6,923,425 | B2 | | 8/2005 | Verdecchia | |
| 6,953,208 | B2 | * | 10/2005 | Warnecke | 285/42 |
| 7,784,242 | B2 | * | 8/2010 | Warnecke | 52/745.16 |
| 2003/0159384 | A1 | | 8/2003 | Warnecke | |
| 2005/0166315 | A1 | | 8/2005 | Warnecke et al. | |
| 2005/0203468 | A1 | | 9/2005 | Warnecke | |
| 2008/0222800 | A1 | * | 9/2008 | Warnecke | 4/695 |
| 2009/0223884 | A1 | * | 9/2009 | Wroblewski et al. | 210/163 |
| 2010/0133159 | A1 | * | 6/2010 | Priester | 210/163 |
| 2010/0319281 | A1 | * | 12/2010 | Egan | 52/302.1 |
| 2011/0023229 | A1 | * | 2/2011 | Warnecke et al. | 4/695 |

OTHER PUBLICATIONS

Web site pp. 1 and 2 for floor drains manufactured by Zurn Industries, Inc., available at www.zurn.com © 2003.

Installation instructions for Z-415 floor drain manufactured by Zurn Industries, Inc., Form FD15, C.N. No. 83044, Aug. 5, 1999, available at www.zum.com © 2003.

Body Assembly specification sheet for Z415B Zurn floor drain, Rev. G, C.N. No. 92376, Jul. 15, 2004, available at www.zurn.com © 2003.

* cited by examiner

MODIFIED DECK PLATE FOR USE WITH CORRUGATED SUPPORT SURFACE

CROSS REFERENCED AND RELATED APPLICATIONS

This application claims the benefit of the filing date of U.S. Provisional Patent Application Ser. No. 60/788,905 filed Apr. 4, 2006, and titled "Modified Deck Plate for Use with Corrugated Support Surface". U.S. Provisional Patent Application Ser. No. 60/788,905 is incorporated herein by reference, in its entirety.

The non-limiting embodiments of this invention can be practiced using the support plates disclosed in U.S. patent application Ser. No. 11/012,894 filed on Dec. 15, 2004, in the names of Lawrence Warnecke, et al., titled "Floor Drain Support Plate", and published as U.S. Patent Application Publication No. 2005/0166315, and in U.S. patent application Ser. No. 11/122,448 filed on May 5, 2005, in the name of Lawrence Warnecke and titled "Drain Support Plate/under-Deck Clamp", and published as U.S. Patent Application Publication No. 2005/0203468. U.S. Patent Application Publication Nos. 2005/0166315 and 2005/0203468 are hereby incorporated by reference, in their entirety.

BACKGROUND OF THE INVENTION

1. Field of the Invention

The present invention relates to floor drains and, more particularly, to a floor drain support plate.

2. Description of Related Art

Presently, floor drains are initially installed utilizing a drain body that can receive either a clamp collar, which receives either a dome or frame, or a frame which also serves as a clamp collar for receipt of a grate. Such prior art floor drain arrangements are manufactured, for example, by Zurn Industries, Inc.

Referring to FIGS. 1 and 2, a typical prior art floor drain 10 includes a receptacle body 12 having a first end 14 and a pipe receiving second end 16 and defining a body cavity 20. The first end 14 of the body 12 includes an annular flange 22 extending away from the cavity 20 of the receptacle body 12. A plurality of spaced apart protrusions 24, preferably four (two are shown and two on an opposite side are not shown in FIGS. 1 and 2), are defined adjacent the first end 14 of the receptacle body 12 underneath the flange 22 and extending in a direction away from the cavity 20 of the receptacle body 12. Each protrusion 24 defines a passageway 26 which can be internally threaded and adapted to receive a fastener F (shown in phantom in FIG. 1). The second end 16 of the receptacle body 12 is adapted to fasten to a drain pipe P (shown in phantom in FIG. 2).

With continued reference to FIGS. 1 and 2, in a prior art method of installing a prior art floor drain 10 in a floor structure, a bore 27 is first cut in a block S, preferably made of Styrofoam® material, and the second end 16 of the receptacle body 12 is placed within the bore 27 of the block S (shown in FIG. 1). The block S is then placed on a wooden board B, such as plywood, and a wire W is wrapped around the receptacle body 12 and secured to the board B via a nail N, as shown in FIG. 1. The floor drain 10 secured on the wooden board B is set in position in the cavity (not shown) in the floor structure (not shown), and concrete C is poured around the receptacle body 12 and the block S, and is allowed to set. The board B is then removed from underneath the floor structure and the block S is chiseled away from the concrete C, thereby creating a void V between the concrete C and the second end 16 of the receptacle body 12 (see FIG. 2). The wire W and the nails are left embedded in the concrete C and any portions of wires W and/or nails N protruding from the concrete are trimmed.

One drawback to the prior art floor drain installation is that the height H (shown in FIG. 1) between the first end 14 of the receptacle body 12 and the board B cannot be adjusted without either cutting the block S or replacing the block S with a larger or smaller block. Another drawback to the prior art method is that installation time is increased because the block S has to be chiseled away from the embedded concrete C. This drawback is eliminated by using the support plate disclosed in U.S. Patent Application Publication No. 2005/0166315 and discussed in more detail below.

Although the support plate of U.S. Patent Application Publication No. 2005/0166315 can be used to adjust the height H, there are limitations. More particularly, the support plate is acceptable for use on floor structures having a flat surface; however, it is not easily adapted for use on floor structures having a corrugated surface.

As can be appreciated by those skilled in the art, it would be advantages to have a support plate that is designed for use on floor structures having a flat surface, or a corrugated surface.

SUMMARY OF THE INVENTION

The present invention provides for a drain support plate adapted to fasten to a receptacle body of a drain. The support plate includes a body having an inner surface and a outer surface and defining a first portion and a second portion. The first portion of the body defines a peripheral edge and the second portion of the body is attached to the peripheral edge of the first portion and axially extends therefrom. The inner surface of the first portion and the second portion of the body define an interior cavity. The first portion of the body defines a center passageway spaced radially apart from the peripheral edge and is adapted to receive a pipe. The first portion of the body also defines at least one slot adapted to be aligned with the receptacle body for receiving a member for attaching the receptacle body to the body of the support plate. Optionally, at least one score line is defined on the first portion adjacent the center passageway of the body of the support plate. In one non-limiting embodiment of the invention, two separate elongated members, e.g. wing sections, extend outward from the second portion of the body.

The present invention also provides for a drain support plate assembly that includes a receptacle body of a drain and a drain support plate as previously discussed. The receptacle body includes a first end and a second end, wherein the first end of the receptacle body defines at least one passageway adapted to receive a fastener and the second end of the receptacle body is adapted to fasten to a pipe. The support plate having a body is attached to the receptacle body via a member for attaching the receptacle body to the body through the slot in the first portion of the body and the receptacle body. The drain support plate assembly further includes a pipe connection attached to the second end of the receptacle body, wherein the pipe connection extends through the center passageway of the body of the support plate. The pipe connection is adapted to fasten to a drain pipe. Optionally, a pipe spacer is positioned around the second end of the receptacle body, wherein the pipe spacer extends from the second end of the receptacle body toward the body of the support plate.

The present invention further provides for a method of installing a drain in a floor structure, preferably a corrugated floor structure. The method includes the steps of providing a receptacle body of a drain and a drain support plate as previously discussed. Next, the receptacle body of the drain is attached to the first portion of the support plate via a member for attaching the receptacle body to the body through the slot in the first portion of the body and the receptacle body. Lastly, the support plate with the attached receptacle body is installed in a corrugated floor structure.

DETAILED DESCRIPTION OF THE INVENTION

Figure 1:
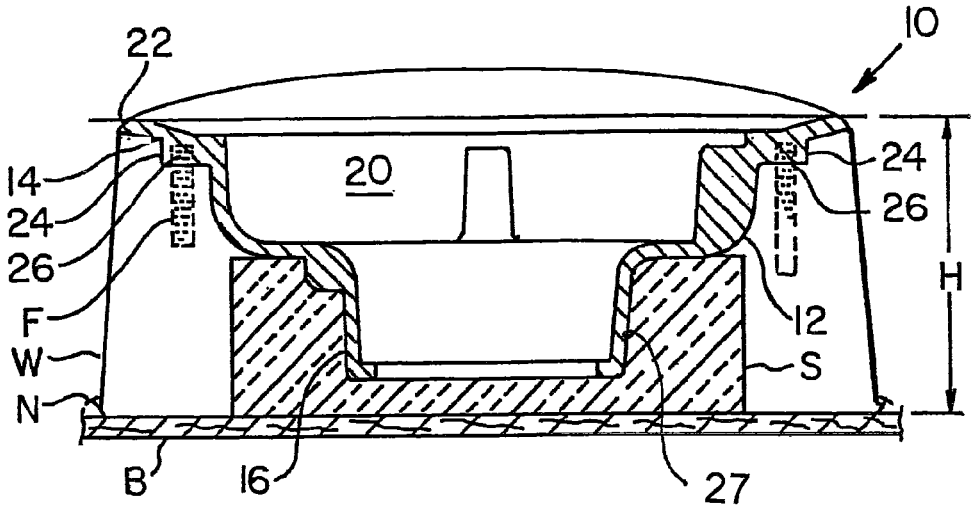
FIG. 1 (PRIOR ART)
FIG. 1 is a partial cross-sectional view of a prior art floor drain installation.
Figure 2:
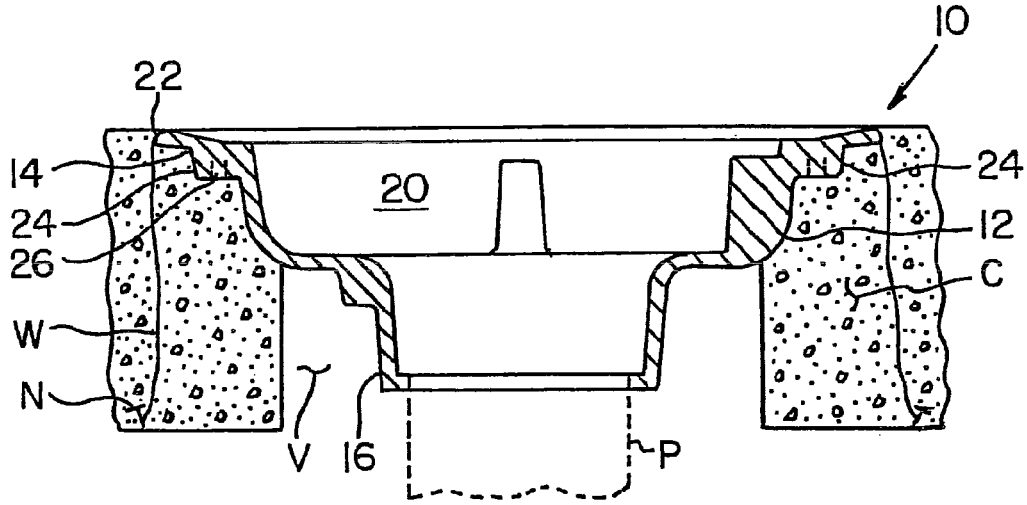
FIG. 2 (PRIOR ART)
FIG. 2 is a partial cross-sectional view of the prior art floor drain installation shown in FIG. 1 embedded in concrete.

As used herein, spatial or directional terms, such as "inner", "outer", "left", "right", "up", "down", "horizontal", "vertical", "front", "back" and the like, unless indicated otherwise, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between, and inclusive of, the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Before discussing non-limiting embodiments of the floor drain support plate of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise in the following discussion, like numbers refer to like elements.

Figure 5:
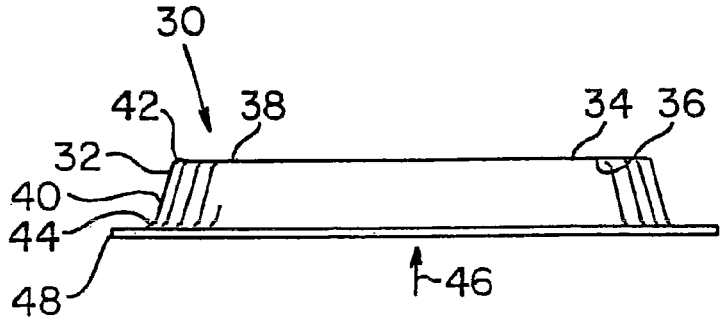
FIG. 5 (PRIOR ART)
FIG. 5 is a side elevational view of the prior art drain support plate shown in FIG. 3.
Figure 3:
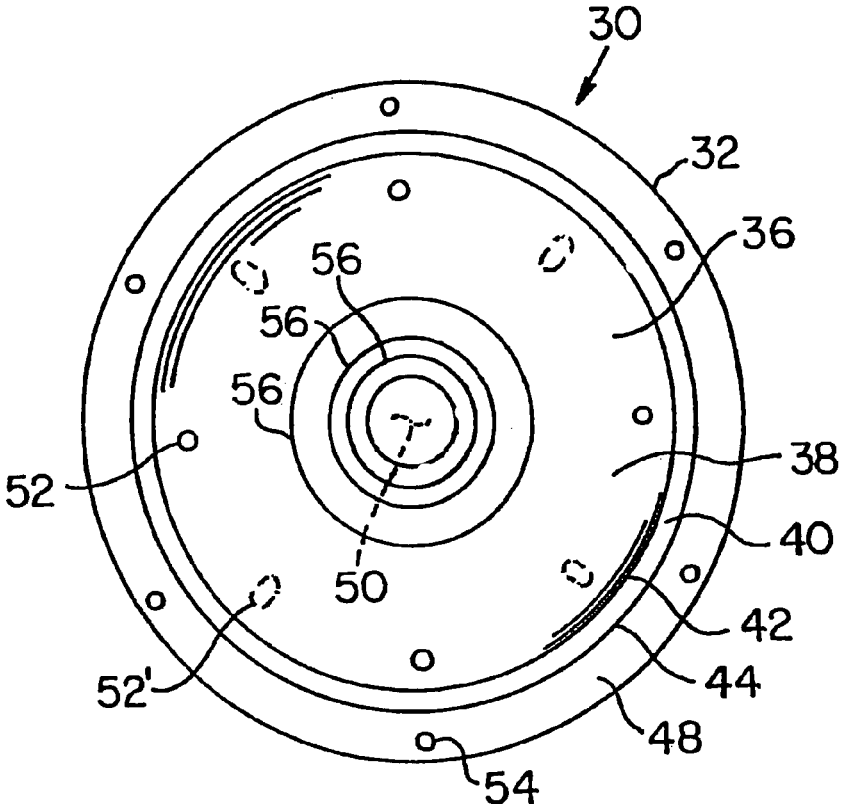
FIG. 3 (PRIOR ART)
FIG. 3 is a bottom plan view of the prior art drain support plate.
Figure 4:
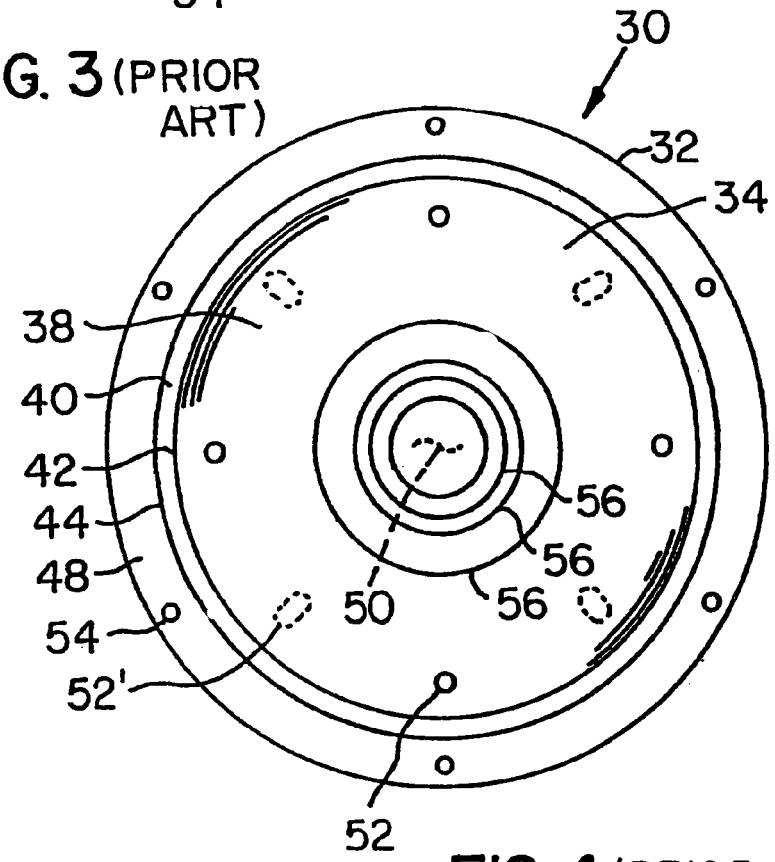
FIG. 4 (PRIOR ART)
FIG. 4 is a top plan view of the prior art drain support plate shown in FIG. 3.
Figure 6:
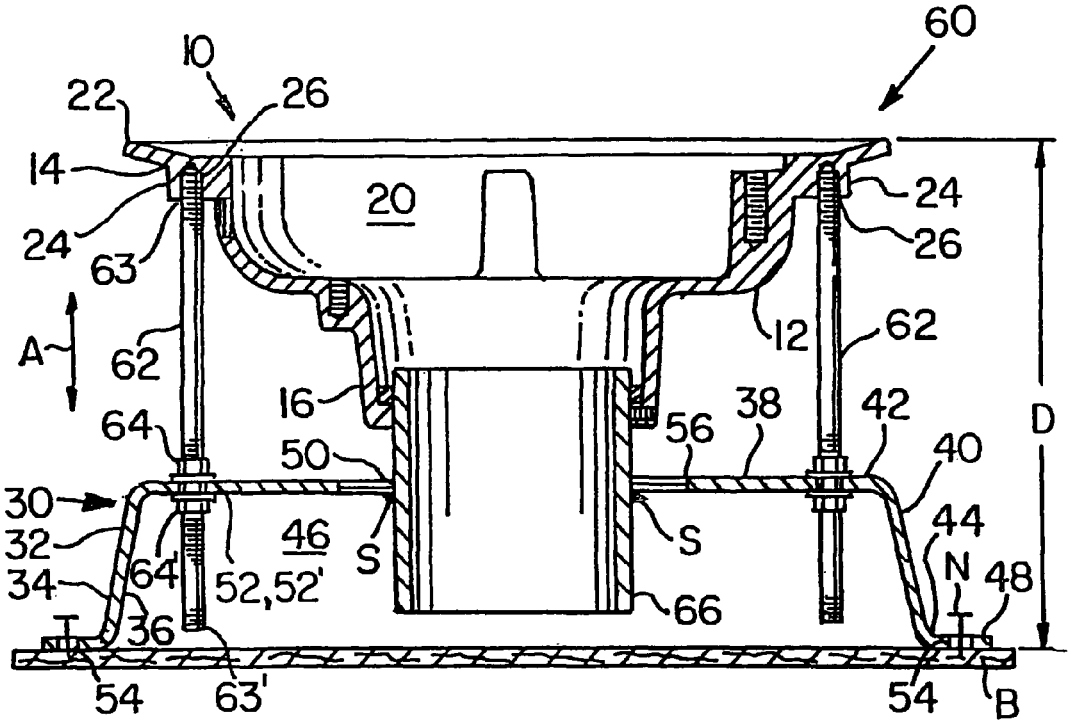
FIG. 6 (PRIOR ART)
FIG. 6 is a partial cross-sectional view showing a prior art floor drain installation made in accordance with the drain support plate shown in FIG. 3.
Figure 7:
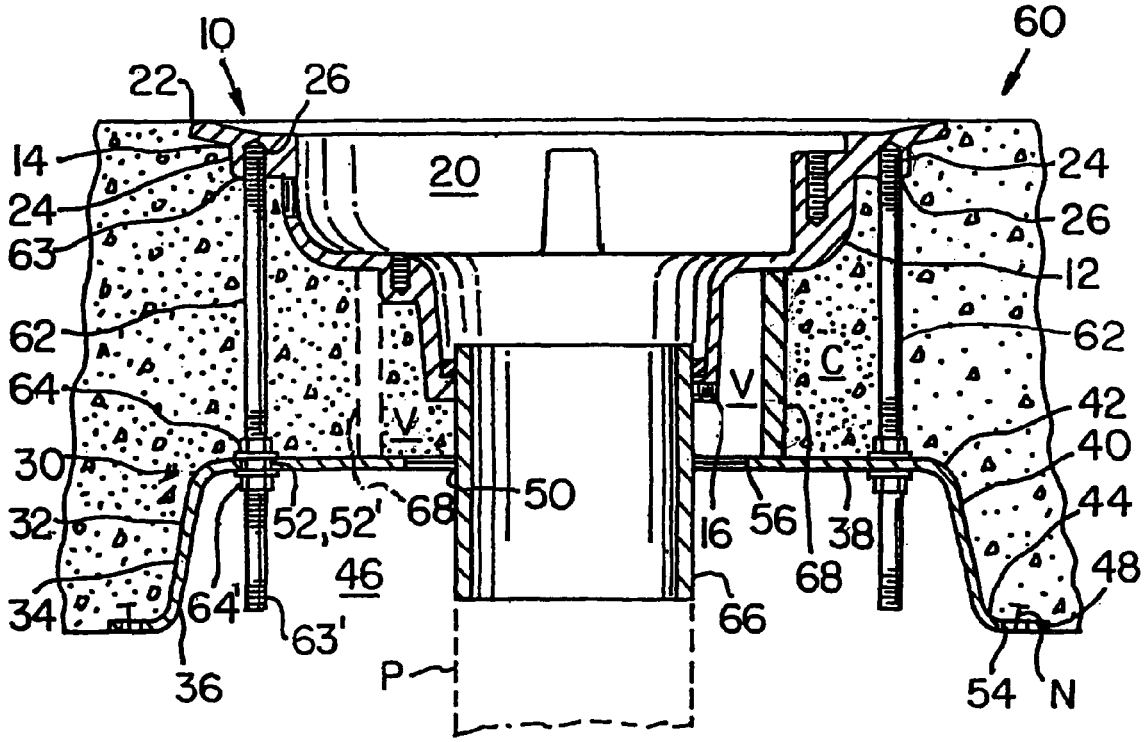
FIG. 7 (PRIOR ART)
FIG. 7 is a partial cross-sectional view of the prior art floor drain installation shown in FIG. 6 embedded in concrete.

For a fuller appreciation of the floor drain support plate of the present invention, the floor drain support plate of U.S. Patent Application Publication No. 2005/0166315 identified by the number 30 in FIGS. 3-7 is discussed. FIGS. 3, 4 and 5 show the features of the floor drain support plate 30 for fastening the support plate 30 to a receptacle body 12 of the prior art floor drain 10 as shown in FIGS. 6 and 7. The support plate 30 includes a body 32 having an outer surface 34 (see FIG. 4) and an inner surface 36 (see FIG. 3) and defining a first portion 38 and a second portion 40. The first portion 38 of the body 32 is preferably disc shaped and defines a peripheral edge 42. The second portion 40 of the body 32 defining an edge 44 is attached to the peripheral edge 42 of the first portion 38 of the body 32 and axially extends therefrom, wherein the inner surface 36 of the body 32 defines an interior cavity 46 (clearly shown in FIGS. 6 and 7). An annular flange 48 is attached to the edge 44 of the second portion 40 and extends in a direction away from the interior cavity 46 of the body 32 of the floor drain support plate 30 (shown in FIG. 5). The first portion 38 of the body 32 may define a center passageway (50 shown in phantom) spaced radially apart from the peripheral edge 42. The center passageway 50 can vary in size and shape in order to accommodate various sizes and shape of pipe. The first portion 38 of the body 32 can also define a plurality of slots 52, 52' (52' shown in phantom in FIGS. 3 and 4) adjacent the peripheral edge 42, wherein the slots 52, 52' are adapted to receive a fastener 62 for securing the support plate 30 to the receptacle body 12 of the floor drain 10 as shown in FIGS. 6 and 7. The slots 52, 52' can vary in size, shape, and number in order to accommodate different size and shape floor drains. The slots 52' can be positioned around a circle having a different radius than a circle on which slots 52 are positioned, wherein the circles are coaxial with each other. The flange 48 also defines a plurality of flange slots 54 (preferably four) adapted to receive a fastener, such as a nail N, for securing the support plate 30 to a board B (shown in FIG. 6). The body 32 of the support plate 30 can be made of a unitary piece of any material, e.g. but not limited to metal or plastic.

Referring back to FIGS. 3 and 4, the first portion 38 of the body 32 of the support plate 30 can include a plurality of score lines 56 defined on the inner surface 36 and/or outer surface 34 adjacent the peripheral edge 42 of the body 32 of the support plate 30. The score lines 56 can vary in size and shape in order to accommodate different size and shape pipe. The first portion 38 of the body 32 of the support plate 30 may or may not have a center passageway 50. When the support plate 30 includes a center passageway 56, the score lines 56 are defined adjacent the center passageway 50. When a section of the first portion 38 of the body 32 of the support plate 30 is removed along one of the score lines 56, a center passageway 50 is either formed, or increased in diameter in order to accommodate various size pipes. Alternatively, the appropriate section defined by one of the score lines 56 can be cut or punched out. Further, the body 32 of the support plate 30 need not include any score lines 56.

FIGS. 6 and 7 show a floor drain support plate assembly 60 that includes the prior art floor drain 10 shown in FIG. 1 attached to the prior art support plate 30 via a fasteners 62. A first end 63 of each of the fasteners 62 is received within it respective one of the passageways 26 of the protrusions 24 in the receptacle body 12. A second end 63' of each of the fasteners 62 passes through it respective slot 52 or 52' in the first portion 38 of the body 32 of the support plate 30. A first flange nut 64 is positioned on each of the fasteners 62 adjacent the outer surface 34 of the body 32 of the support plate 30, and a second flange nut 64' is positioned on each of the fasteners adjacent the inner surface 36 of the body 32 of the support plate 30. The fasteners 62 preferably are threaded fasteners that can be threadably received within the passageways 26 of the protrusion 24 in the receptacle body 12. However, it is contemplated that fasteners 62 can be formed in the receptacle body 12 for engagement with slots 52, 52' for attaching the receptacle body 12 to the support plate 30. The distance D (shown in FIG. 6) between the receptacle body 12 and the support plate 30 and the angle of the drain relative to the surface of the concrete floor can be adjusted by longitudinally moving the nuts 64, 64' along selected ones of the fasteners 62.

With continued reference to FIGS. 6 and 7, the support plate assembly 60 further includes a pipe connection 66 attached to the second end 16 of the receptacle body 12, wherein the pipe connection 66 extends through the center passageway 50 of the body 32 of the support plate 30. The pipe connection is adapted to fasten to a drain pipe P (shown in phantom in FIG. 7). A pipe spacer 68 (shown in phantom in FIG. 7) can also be positioned around the second end 16 of the receptacle body 12, wherein the pipe spacer 68 is spaced from the second end 16 of the receptacle body 12 and extends toward first portion 38 of the body 32 of the support plate 30.

The following describes a method of installing a prior art floor drain 10 in a floor structure utilizing the prior art floor drain support plate 30. First, the size of a drain pipe P is determined, such as 2", 3", 4", or 6" pipe, and the support plate 30 having a center passageway 50 corresponding to the size and shape of the drain pipe P is provided. Alternatively, a section of the first portion 38 of the body 32 of the support plate 30 can be removed along a score line 56 (shown in FIGS. 3 and 4) corresponding to the size of the drain pipe P, thereby forming or increasing the size of the center passageway 50. Second, the passageway 26 in each protrusion 24 of the receptacle body 12 is aligned with a respective slot 52, 52' in the first portion 38 of the body 32 of the support plate 30, and a fastener 62 is used to attach the receptacle body 12 to the support plate 30. For attachment to occur, a first flange nut 64 is fastened onto the fastener 62 and a first end 63 of the fastener 62 is received within the passageway 26 of the protrusion 24 of the receptacle body 12. A second end 63' of the fastener 62 then passes through a slot 52, 52' in the support plate 30, wherein the first flange nut 64 abuts against the outer surface 34 of the first portion 38 of the body 32 of the support plate 30. A distance D between the receptacle body 12 and the support plate 30 can be increased or decreased by longitudinally moving the first flange nut 64 in either direction represented by arrow A along the fastener 62 (shown in FIG. 6). Once the distance D is determined, a second flange nut 64' is fastened onto the second end 63' of the fastener 62 and moved toward the inner surface 36 of the body 32 of the support plate 30, thereby fixing the distance D between the receptacle body 12 and the support plate 30. The distance D can still be adjusted by longitudinally moving both flange nuts 64, 64' along the fastener 62. Third, a pipe connection 66 can be connected to the second end 16 of the receptacle body 12, wherein the pipe connection 66 extends through the center passageway 50 of the body 32 of the support plate 30 and can be adapted to be used to attach future drain pipe P (shown in phantom in FIG. 7). A sealant S (shown only in FIG. 6), such as rubber or foam, can be placed between the pipe connection 66 and the center passageway 50 of the support plate 30 in order to fill in any gap that may exist. However, a pipe connection 66 does not have to be installed in order for a future drain pipe P to be connected to the second end 16 of the receptacle body 12. Fourth, the support plate 30 is then fastened to a board B via a fastener, such as a nail N, passing through a flange slot 54 in the flange 48 of the body 32 of the support plate 30, as shown in FIG. 6. Referring to FIG. 7, after the board B is set over the hole in the floor structure, concrete C is then poured around the receptacle body 12 and the support plate 30. The support plate 30 prevents any concrete C from contacting the pipe connection 66 within the interior cavity 46 of the body 32 of the support plate 30, thus creating an empty space. The term "floor structure" as used herein refers to the support for the concrete while it sets. The empty space created in the underside of the concrete after it sets allows for a future drain pipe P (shown in phantom) to be attached to the pipe connection 66. A pipe spacer 68 (shown in phantom on the left side of FIG. 7) can be positioned around the second end 16 of the receptacle body 12, wherein the pipe spacer 68 is spaced from the second end 16 of the receptacle body 12 and extends toward and preferably contacts the first portion 38 of the body 32 of the floor drain support plate 30. The pipe spacer 68, which can be a plastic pipe, prevents the poured concrete C from flowing into contact with a section of the pipe connection 66 above the support plate 30, thus creating a void V (absence of concrete shown only on the right side of FIG. 7). As can be appreciated, in the case of a void V, the concrete shown in on the left side of FIG. 7 positioned radially inwardly from the pipe spacer 68 would not be present, and the void V would be defined as shown on the right side of FIG. 7 between the pipe spacer 66, a portion of the receptacle body 12, a portion of the pipe connection 60, and a portion of the support plate 30. This void V allows the pipe connection 66 to be removed without chiseling away at the concrete C or inserted in to the floor drain 10 at a later date. Once the concrete C is cured, the board B is then removed from the underside of the floor structure. The second end 63' of the fasteners 62 and nails N can be later trimmed.

An advantage of the support plate assembly 60 is that an installer can level and adjust the floor drain 10 to the required height prior to pouring the concrete. Further, the support plate 30 also prevents the location of the floor drain 10 from becoming altered (such as from being kicked or stepped on) prior to pouring the concrete.

The above-described support plate and method corresponds to U.S. Patent Application Publication No. 2005/0166315. The present invention is for use with corrugated support and is similar to support drain 30 except for the below noted differences.

Figure 8:
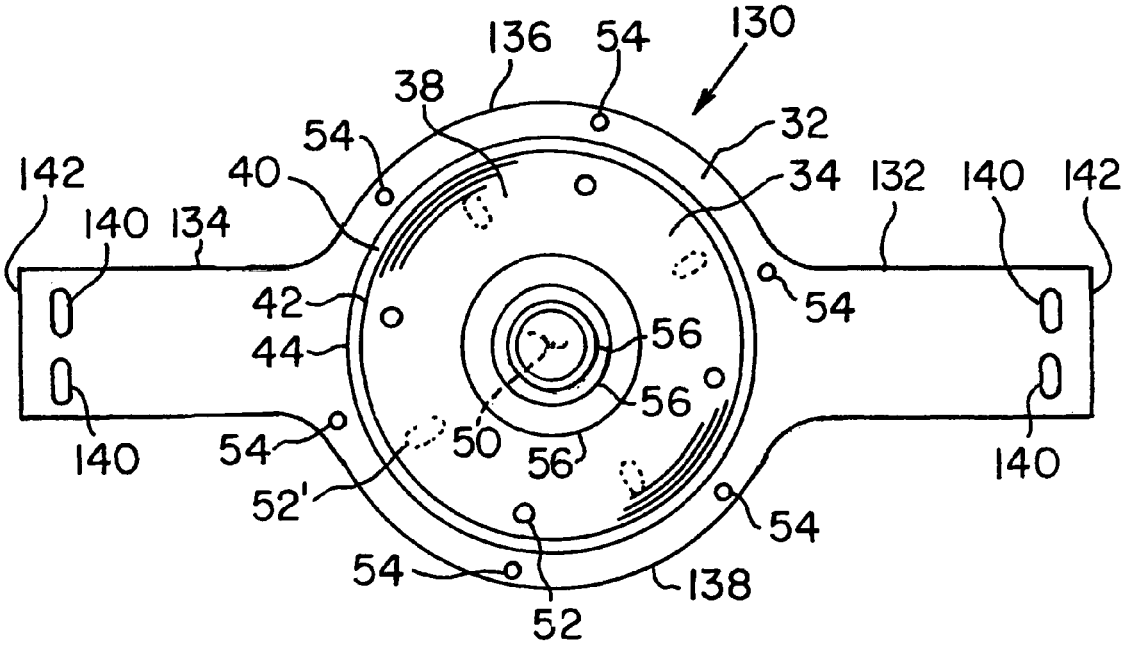
FIG. 8 is a top plan view of a non-limiting embodiment of a floor drain support plate of the present invention.
Figure 9:
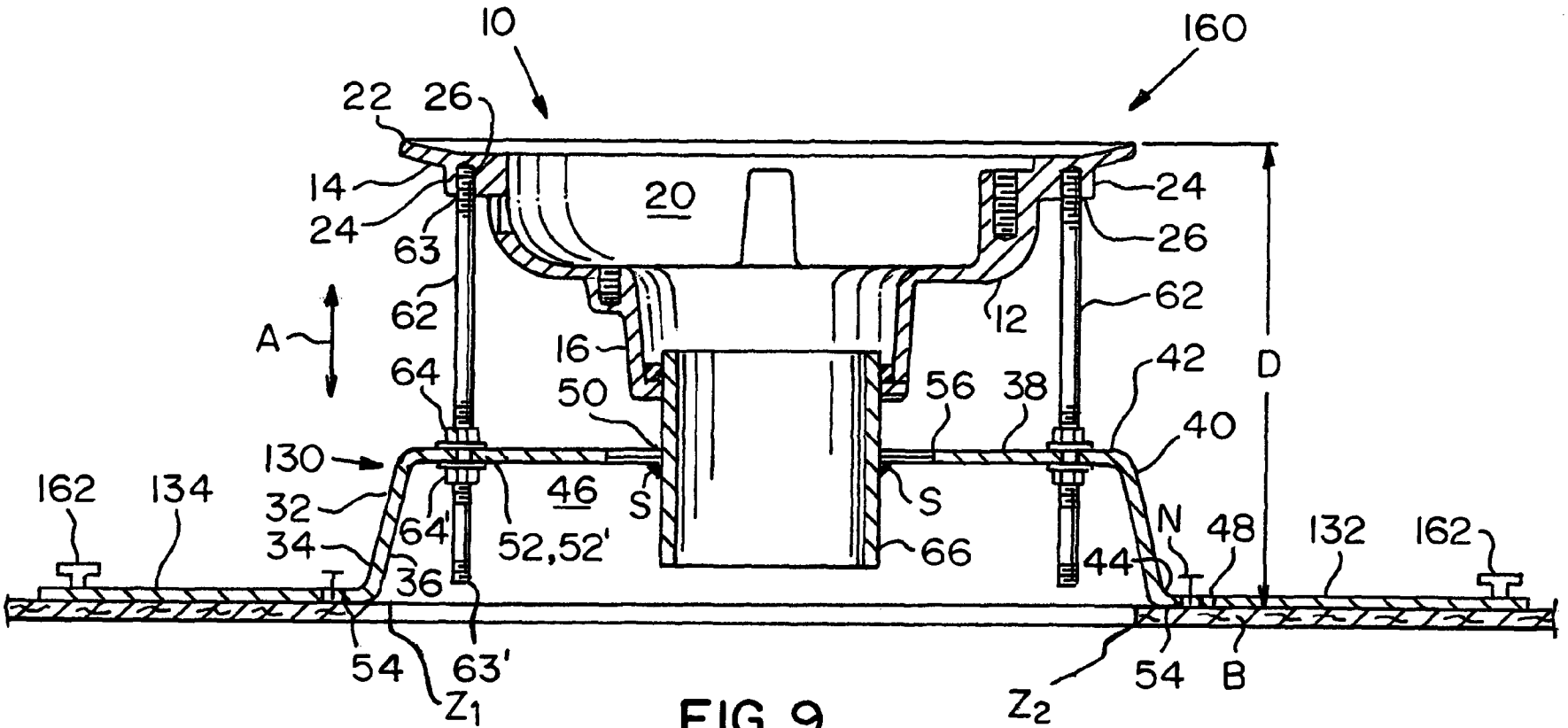
FIG. 9 is a view similar to the view of FIG. 6 showing a floor drain mounted in accordance to the present invention on the floor drain support plate shown in FIG. 8.

With reference to FIG. 8, there is shown one non-limiting embodiment of a floor drain support plate designated by the number 130. The support plate 130 includes the features of the support plate 30 shown in FIGS. 3-5 and in place of the circular flange 48 (see FIG. 3), the support plate 130 has pair of elongated members or wing sections 132, 134 opposite to one another and extending away from the body 32 with flange portions 136, 138 circumscribing the remainder of the body 32. The holes 54 are in the flange portions 136, 138 and portions of the wing sections 132, 134. The wing sections 132, 134 optionally have slots at the end 142 of the wing sections 132, 134 for securing the ends 142 of the wing sections 132, 134 in position as discussed below. With reference to FIG. 9, there is shown a floor drain support plate assembly 160 including the floor drain 10 and the support plate 130 of the invention. The support plate 130 is mounted to the board B. A passageway may be defined in the board B, where the hole is aligned with passageways 50 and the cavity 20. In one non-limiting embodiment of the invention, the nails N are driven through the slots 140 in the ends 142 of the wing sections 132, 134 to secure the wing sections of the support plate to the board B. In another non-limiting embodiment of the invention, T-shaped fasteners 162 (shown only in FIG. 9) are provided in the slots 140, or at the end portions, of the wing sections 132, 134 in any convenient manner. The T-shaped fasteners are embedded into the concrete C to secure the ends of the wing sections to the concrete. In still another non-limiting embodiment of the invention, the slots 140 at the end 142 of the wing sections 132, 134 extend over the end of the board and are secured to the floor structure by fasteners, e.g. but not limited to nails. With this arrangement, the floor drain support plate assembly 160 is secured to the floor structure.

Figure 10:
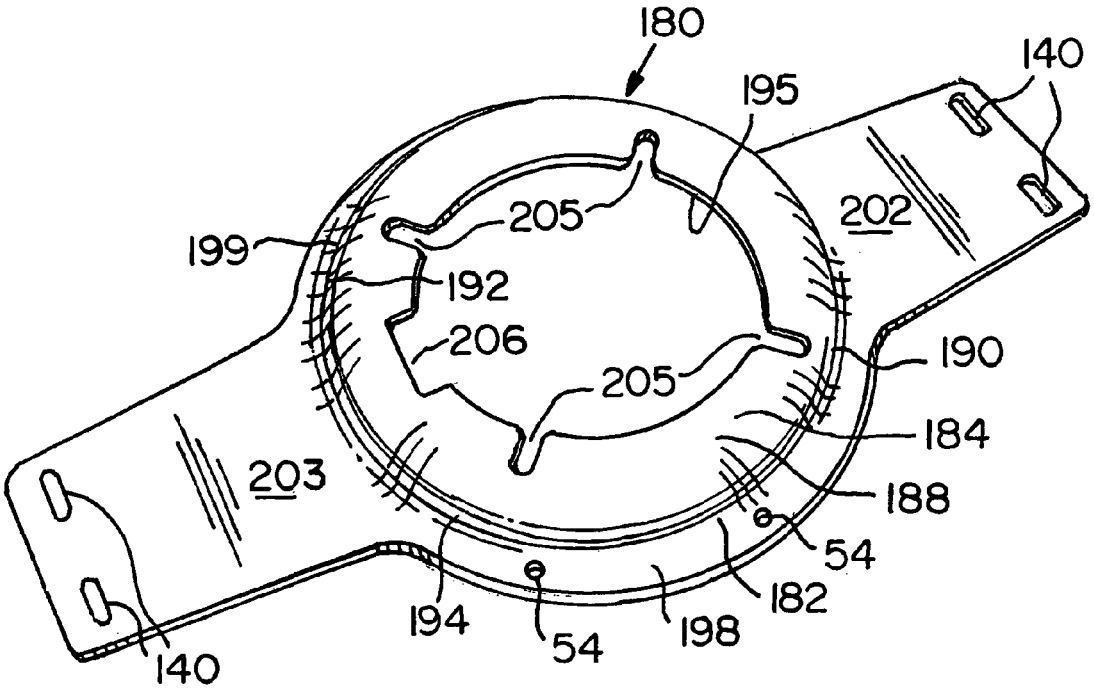
FIG. 10 is a top perspective view of another non-limiting embodiment of a floor drain support plate of the present invention.
Figure 11:
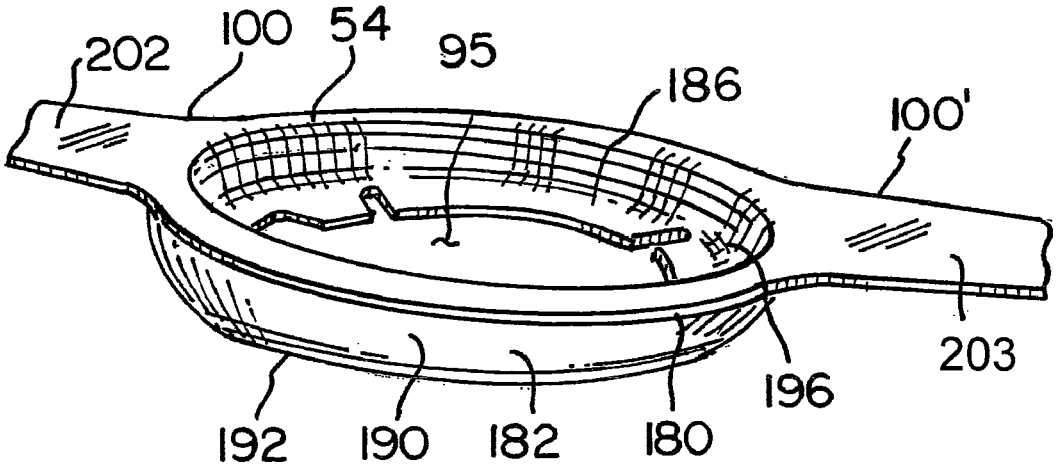
FIG. 11 is a side perspective view of the floor drain support plate shown in FIG. 10.

The invention is not limited to the configuration of the passageway that receives the second end 16 of the floor drain 10, e.g. the passageway 50 (see FIG. 3). As is appreciated by those skilled in the art, the outer configuration of the floor drains vary and the walls of the passageway can be configured accordingly. More particularly, shown in FIGS. 10 and 11 is another non-limiting embodiment of the invention designated by the number 180. The support 180 includes a body 182, outer surface 184, inner surface 186, a first portion 188, a second portion 190, an edge 192, an edge 194 and a central passageway 195. The support plate 180 further includes an interior cavity 196, flange portions 198, 199, wings 202, 203 having the holes or slots 140, and the slots or holes 54. Although not limiting to the invention, the support plate 180 has four grooves 205 for receiving the fasteners 62 (see FIG. 6) and a cut out 206 for any extensions of the drain.

Figure 12:
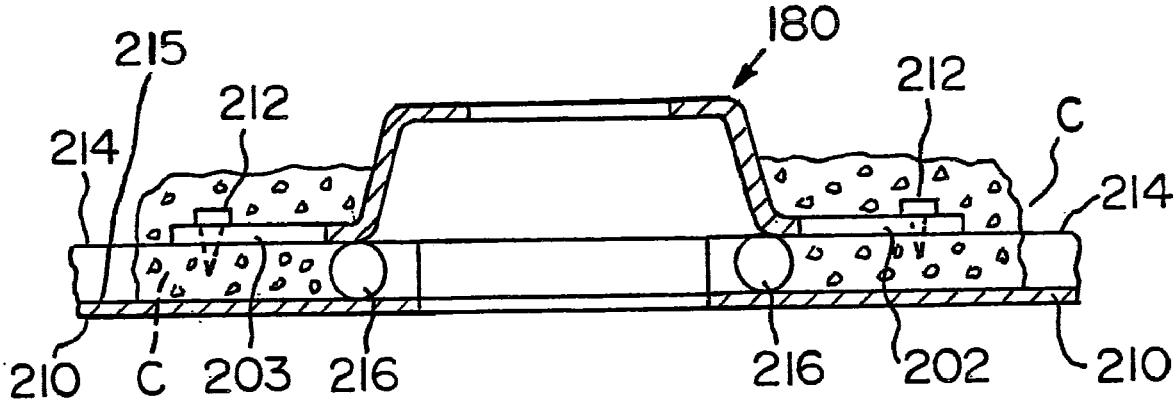
FIG. 12 is a side elevational view of the floor drain support plate shown in FIG. 10 installed on a floor structure having a corrugated surface in accordance to the teachings of the invention.
Figure 13A:
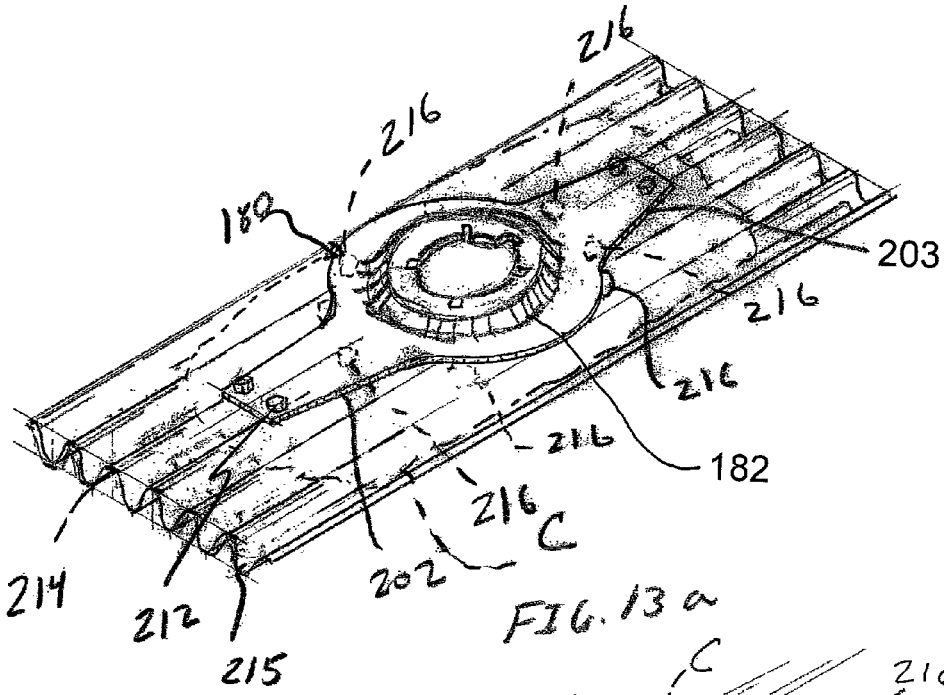
FIG. 13*a* is a top perspective view of the floor drain shown in FIG. 12 with a layer of concrete shown in phantom.

As shown in FIGS. 12 and 13*a*, in this non-limiting embodiment of the invention, the support plate 180 is mounted to a corrugated floor structure 210. Corrugated floor structures are well known in the art and include a plurality of longitudinally extending spaced apart peak and valley sections. The wings 202, 203 of the support plate 180 are attached in any convenient manner, e.g. by fasteners 212, to the higher levels or peaks 214 of the corrugated support 210. Gasket material 216, such as silicone rubber, can be used to block or act as a barrier the interior of the support plate 180 with the lower levels or valleys 215. With this arrangement, when concrete C is poured around the support plate, the wings 202, 203 are embedded in the concrete C. As can be appreciated, the invention contemplates embedding the support plate 30, 130, 180 in the concrete C, and after the concrete sets mounting the floor drain on the support plate, or mounting the floor drain on the support plate, e.g. as discussed above and positioning the floor drain support plate assembly to the floor structure as discussed above.

Figure 13B:
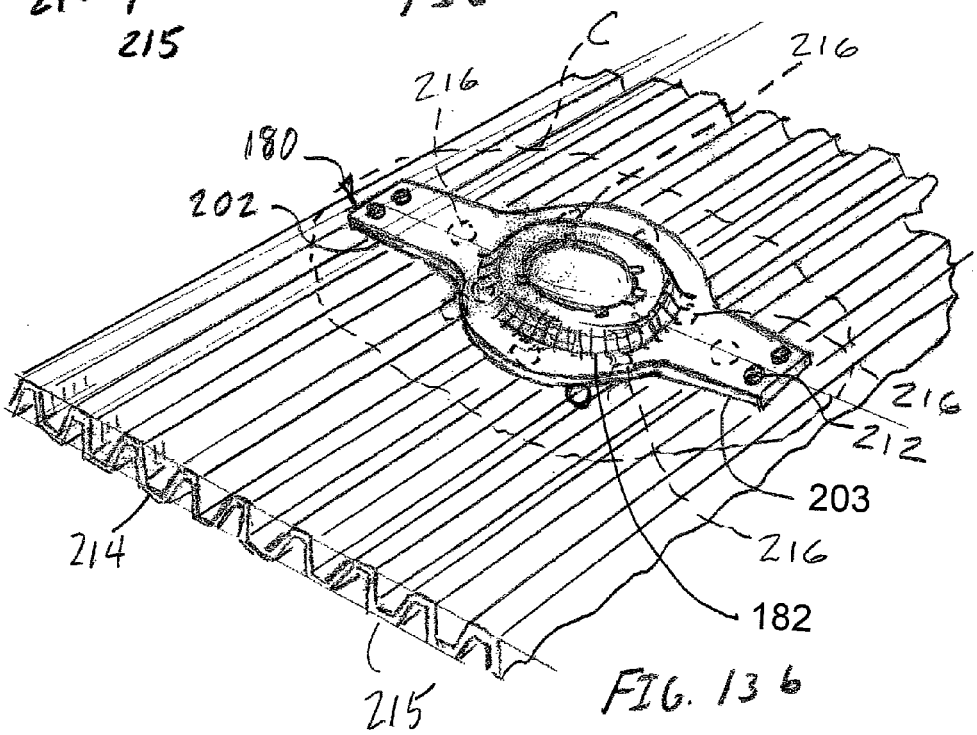
FIG. 13*b* is a top perspective view of a floor drain system similar to FIG. 13*a* except for the direction of the roof corrugations relative to the drain support plate.

FIG. 13*b* is similar to FIG. 13*a* except for the direction of the corrugations of the floor structure 210, which is rotated 90° from those shown in FIG. 13*a*. Like reference numerals are used for like elements. Further, as shown in FIGS. 10, 11, 13*a*, and 13*b*, in another non-limiting embodiment of the invention, the width of the elongated members 202 and 203 decreases as the distance from the body 182 increases, or, stated another way, the width of the elongated members 202 and 203 decreases as the distance from the end portion having the holes 212 (see FIGS. 13*a* and 13*b*) of their respective elongated members 202 and 203 decreases.

It will be readily appreciated by those skilled in the art that modifications can be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. In combination a receptacle drain attached to a drain support for a drain, the drain support comprising:

a body comprising a first open end, an opposite second open end, a concave surface between the first and the second open ends, and an opposite convex surface between the first and the second open ends, wherein the opening of the first open end is smaller than the opening of the second open end and the first open end configured to receive fasteners to secure the receptacle drain in a position spaced from, and in facing relationship to, the first open end of the body and wherein a body of the receptacle drain comprises a first end and a second end, wherein the first end of the body of the receptacle drain defines at least one passageway adapted to receive a fastener and the second end of the body of the receptacle drain is adapted to fasten to a pipe; and a pair of elongated members attached to the second end of the body and extending away from the body and terminating in an end portion.

2. In combination a receptacle drain attached to a drain support for a drain, the drain support comprising:

a body comprising a first open end, an opposite second open end, a concave surface between the first and the second open ends, and an opposite convex surface between the first and the second open ends, wherein the opening of the first open end is smaller than the opening of the second open end and the first open end configured to receive fasteners to secure the receptacle drain in a position spaced from, and in facing relationship to, the first open end of the body;

a pair of elongated members attached to the second end of the body and extending away from the body and terminating in an end portion;

a body of the receptacle drain comprises a first end and a second end, wherein the first end of the body of the receptacle drain defines at least one passageway adapted to receive a fastener and the second end of the body of the receptacle drain is adapted to fasten to a pipe;

a pipe connection adapted to fasten to a drain pipe, the pipe connection attached to the second of the receptacle body, wherein the pipe connection extends through the first open end of the body of the support plate; and a pipe spacer positioned around the second of the body of the receptacle drain, wherein the pipe spacer extends from the second end of the body of the receptacle drain toward the body of the support plate.

3. A drain support for a drain, comprising:

a body having a concave surface, an opposite convex surface and a base, the base having a passageway there through, walls of the passageway configured to receive fasteners to secure a floor drain in a position spaced from, and in facing relationship to, the convex surface of the body; and a pair of elongated members attached to and extending away from the body and terminating in an end portion, wherein the elongated members are opposite to one another and width of the elongated members decreases as the distance from the body increases.

4. The drain support according to claim 3, wherein the elongated members each have at least one of the arrangements selected from the group of a hole in the end portion, a pair of elongated holes in the end portion and a tab at the end portion extending away from a major surface of its respective one of the elongated members.

5. A method of installing a drain in a floor structure, wherein the floor structure is a corrugated floor structure comprising:

providing a drain support plate comprising:

a body having a concave surface, an opposite convex surface, and a base, the base having a passageway therethrough, walls of the passageway configured to receive fasteners to secure a floor drain in a position spaced from, and in facing relationship to, the convex surface of the body, and a pair of elongated members attached to and extending away from the body and terminating in an end portion;

attaching a receptacle body of a drain to the body of the support plate;

attaching end portions of the elongated members to the floor structure; and providing a sealant between concave portions of the corrugated floor and the support plate.

6. The method according to claim 5, wherein the body of the support plate has an inner surface and an outer surface and defining a first portion and a second portion, the first portion of the body defining a peripheral edge, the second portion of the body attached to the peripheral edge of the first portion and axially extends therefrom, wherein the inner surface of said first portion is the concave surface of the support plate and defines an interior cavity, the first portion of the body of the support plate defines the passageway wherein the passageway is spaced radially apart from the peripheral edge and is adapted to receive a pipe, the first portion of the body of the support plate defining at least one slot adapted to be aligned with the receptacle body for receiving a member for attaching the receptacle body to said body of said support plate, and a flange attached to said second portion of said body and extending away from the interior cavity, said flange defining at least one flange slot adapted to receive a fastener, and the two opposed elongated members extending from said flange.

7. In combination a support structure and a drain support plate attached to the support structure, the support plate comprising:

a body having an inner surface and an outer surface and defining a first portion and a second portion, said first portion of said body defining a peripheral edge, said second portion of said body attached to the peripheral edge of said first portion and axially extends therefrom, wherein said inner surface of said first portion and said second portion of said body define an interior cavity, said first portion of said body defining a center passageway spaced radially apart from the peripheral edge and adapted to receive a pipe, said first portion of said body defining at least one slot adapted to be aligned with a receptacle body for receiving a member for attaching the receptacle body to said body of said support plate, a flange attached to said second portion of said body and extending away from the interior cavity, said flange defining at least one flange slot adapted to receive a fastener, and two opposed elongated members extending from said flange;

wherein fasteners secure each of the respective elongated members to the support structure, wherein a barrier is positioned between the support structure and the drain support plate.

8. The combination as claimed in claim 7, wherein the support structure is a corrugated support plate having a plurality of longitudinally extending and spaced apart peaks and valleys, wherein at least one of the elongated members of the drain support plate is attached to at least one peak of the corrugated support plate.

* * * * *

UNITED STATES PATENT AND TRADEMARK OFFICE

CERTIFICATE OF CORRECTION

PATENT NO. : 8,261,379 B2
APPLICATION NO. : 11/732114
DATED : September 11, 2012
INVENTOR(S) : Vince Miller It is certified that error appears in the above-identified patent and that said Letters Patent is hereby corrected as shown below:

Column 8, Line 51, Claim 2, after "second" insert -- end --

Column 8, Line 54, Claim 2, after "second" insert -- end --

Signed and Sealed this
Fourth Day of December, 2012

David J. Kappos

David J. Kappos
*Director of the United States Patent and Trademark Office*